United States Patent [19]

Louhio

[11] 4,398,450

[45] Aug. 16, 1983

[54] HYDRAULIC MOTOR

[75] Inventor: Aaro I. Louhio, Helsinki, Finland

[73] Assignee: Oy Partek AB, Finland

[21] Appl. No.: 173,731

[22] Filed: Jul. 30, 1980

[30] Foreign Application Priority Data

Aug. 1, 1979 [FI] Finland ..... 792406

[51] Int. Cl.[3] ..... F01B 1/06

[52] U.S. Cl. ..... 91/477; 91/492; 91/497

[58] Field of Search ..... 91/477, 478, 492, 497

[56] References Cited

U.S. PATENT DOCUMENTS

| | | | |
|---|---|---|---|
| 1,998,004 | 4/1935 | Ernst | 91/477 X |
| 2,163,080 | 6/1939 | Benedek | 91/492 |
| 3,863,447 | 2/1975 | Foster et al. | 91/492 X |
| 4,326,450 | 4/1982 | Bacquie | 91/491 X |

FOREIGN PATENT DOCUMENTS

| | | | |
|---|---|---|---|
| 888206 | 7/1949 | Fed. Rep. of Germany | 91/477 |
| 1322891 | 7/1973 | United Kingdom | 91/492 |
| 193243 | 4/1967 | U.S.S.R. | 91/492 |

*Primary Examiner*—William L. Freeh

*Attorney, Agent, or Firm*—Fitch, Even, Tabin & Flannery

[57] ABSTRACT

A hydraulic motor with two sets of cylinders, the diameters of the two cylinder sets being of different dimension in order to produce three speed ranges. The pressure medium is directed to either both cylinder sets, the cylinder set of larger diameter of the cylinder set of smaller diameter by means of a valve structure comprising sliding spindles arranged in the hollow center axle of the motor, the pressure force of the pressure medium being utilized for moving the valve spindles.

8 Claims, 9 Drawing Figures

HYDRAULIC MOTOR

The subject of the present invention is a hydraulic motor that has two cylinder sets fitted around the axle.

Similar hydraulic motors are known in which the cylinder sets have equal diameters and which can, consequently, with a certain flow of pressure medium, operate in two speed ranges so that either both cylinder sets are in operation or only one of them. In order to produce a third speed range, the use of a third cylinder set has been suggested. Moreover, in known hydraulic motors the passing of the pressure medium into the various pistons of the cylinder sets and into the cylinder set desired at each particular time has been carried into effect by means of quite complicated valve constructions, which are both spacious and exposed to wear.

The object of the present invention is to provide a novel hydraulic motor which is of a simple construction and of a small size in relation to its power, reliable in operation, and which does not need components that are worn rapidly.

The hydraulic motor in accordance with the invention is characterized in that the cylinder sets have diameters of different magnitude, that in both cylinder sets, certain pistons, when performing their power stroke and exhaust stroke, control the pressure medium flows of a certain following cylinder belonging to the same cylinder set via control grooves in the pistons and channel connections in the cylinder blocks, and that into a bore formed into the axle of the motor, a glide-spindle valve construction controlled by the pressure medium is fitted so as to guide the pressure medium alternatively into both cylinder sets, into the larger-diameter cylinder set only, or into the smaller-diameter cylinder set only, and in the latter two cases to control the cylinder set remaining without pressure medium to the neutral position.

By means of the motor in accordance with the invention, three speed ranges are achieved, the first range, in which the pistons of both cylinder sets are affected by the pressure medium, the second range, in which the pistons of the smaller set of cylinders are switched off, and the third one, in which the pistons of the larger set of cylinders are switched off and the pistons of the smaller cylinder set are switched into operation. A great advantage of the internal control of pressure medium in the cylinder sets, carried into effect by means of piston grooves, is that it is independent from the number of cams in the cam rings and, under these circumstances, moreover, the transmission ratios can be easily changed practically arbitrarily by just changing cam rings in respect of the desired cylinder set. A glide spindle placed in the motor axle requires little space and is not exposed to wear.

The valve spindle construction favourably includes a first hollow valve spindle, which moves between two positions and in whose cylindrical wall or mantle there is a first opening for connecting the interior space of the spindle with the hydraulic pressure medium supply channel in both positions of the spindle, a second opening, which is dimensioned so that it in the first position of the spindle connects the interior space with the pressure openings of the larger cylinder set and in the second position of the spindle breaks this connection, a third opening, which in the second position of the spindle connects the interior space with the pressure openings of the smaller cylinder set, a fourth opening, which is in the first position of the spindle connected to the pressure openings of the smaller cylinder set, an axial recess for the formation of connection from the return openings of both cylinder sets to the return channel for pressure medium, and an axial groove connected to the reservoir or tank space, which axial groove is provided with a lateral notch so as to produce connection from the return openings of the larger cylinder set to the tank space in the second position of the spindle, a second hollow valve spindle, which is fitted as movable inside the first spindle so that its mantle, in the first position of the second spindle in relation to the first spindle, permits connection from the interior space of the first spindle to the pressure openings of the smaller cylinder set through the fourth opening of the first spindle and, in the second position of the second spindle in relation to the first spindle, blocks this connection, and in whose mantle an axial widening has been formed so as to open connection through a groove formed in the inside wall of the spindle from the fourth opening of the first spindle to the tank space when the second spindle is in its second position in relation to the first spindle, and a piston, which rests against the first valve spindle so as to move the latter.

The desired movements are favourably produced so that the faces through which the pressure medium can act axially upon the first spindle, upon the second spindle, and upon the piston are dimensioned so that the face concerned of the second spindle is larger than the face of the first spindle but smaller than the face of the piston. Under these circumstances, the motor operates in the first speed range when the first spindle of the valve spindle construction is alone under the effect of pressure medium, being, like the second spindle, in its first position, in the second speed range when the second spindle is also under the effect of the pressure medium, shifting into its second position in relation to the first spindle and breaking off the connection of the pressure medium to the smaller cylinder set, and in the third speed range when the pressure medium additionally acts upon the piston fastened to the first spindle and moves the first spindle to its second position, together with the second spindle, whereby the pressure medium can act upon the smaller cylinder set but not upon the larger cylinder set.

A problem of known hydraulic motors designed to be mounted in vehicle wheels has been that when the hydraulic system has broken down out of some reason or other, the pistons in the cylinders can no longer be switched to the neutral position and towing of the vehicle has been practically impossible.

A preferred embodiment of the invention is characterized in that, in order to permit unhindered towing when the hydraulic pressure of the motor is lost, a radial bore is formed in connection with the groove in the interior wall of the first spindle, that a sleeve acted upon by a spring is fitted around the spindle above this bore as gliding, the end of said sleeve facing away from said spring being via the choked connection under the pressure prevailing at the fourth opening of the spindle, and that said sleeve is so dimensioned that it, in its first position, when the force of the hydraulic pressure is higher than the force of the spring, covers said radial bore and, in its second position, to which it is pushed by the spring after loss of the hydraulic pressure, makes the bore free and opens connection from the interior space of the first spindle to the pump driven by the rotating movement of the motor.

When the hydraulic system has broken down and the vehicle starts being towed, the pressure formed in the interior space of the first spindle is discharged through said opened connection into the suction space of the pump and the pressure developed by the pump in the casing space keeps the pistons in the inner positions thereby permitting unhindered towing. The pressure produced in the interior space of the first spindle, which is in itself high enough to surpass the spring acting upon the sleeve, does not have time to act upon the sleeve because of the said choked connection.

Below, the invention will be described in detail with reference to the exemplifying embodiment shown in the attached drawing.

Figure 2:
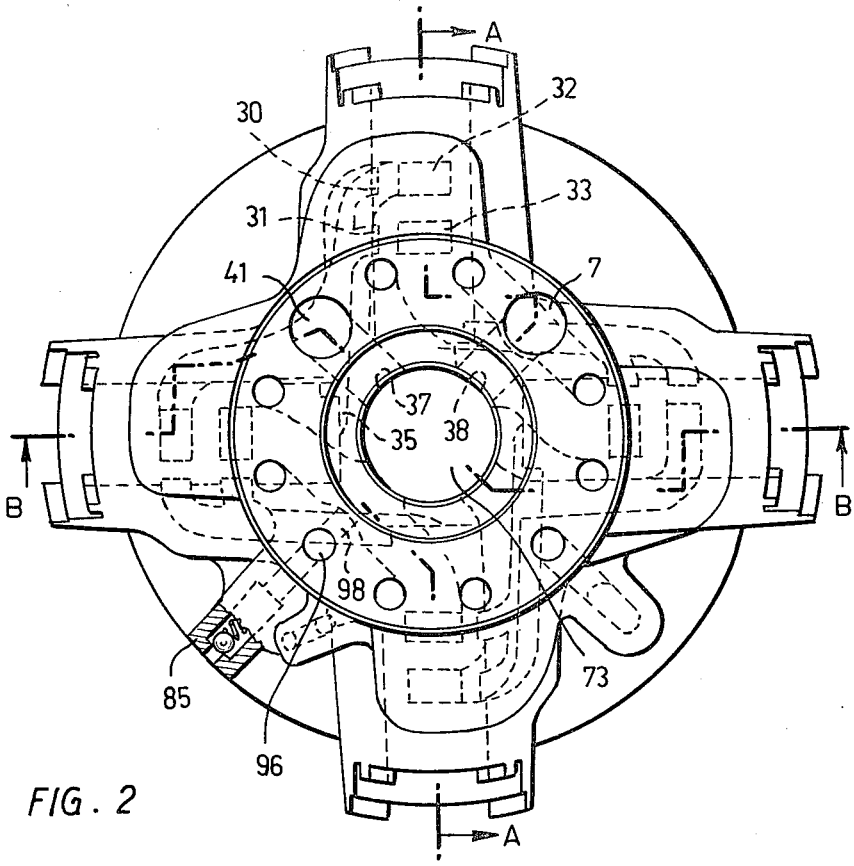
FIG. 2 shows the motor as an end view, with the flange removed.
Figure 2A:
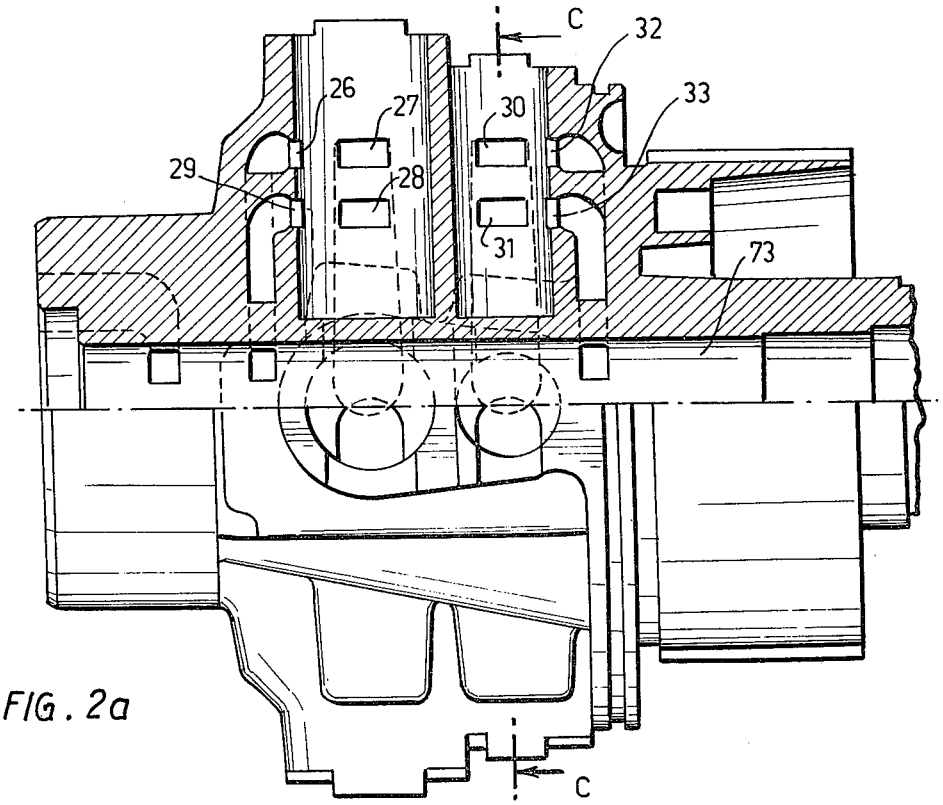
Figure 3:
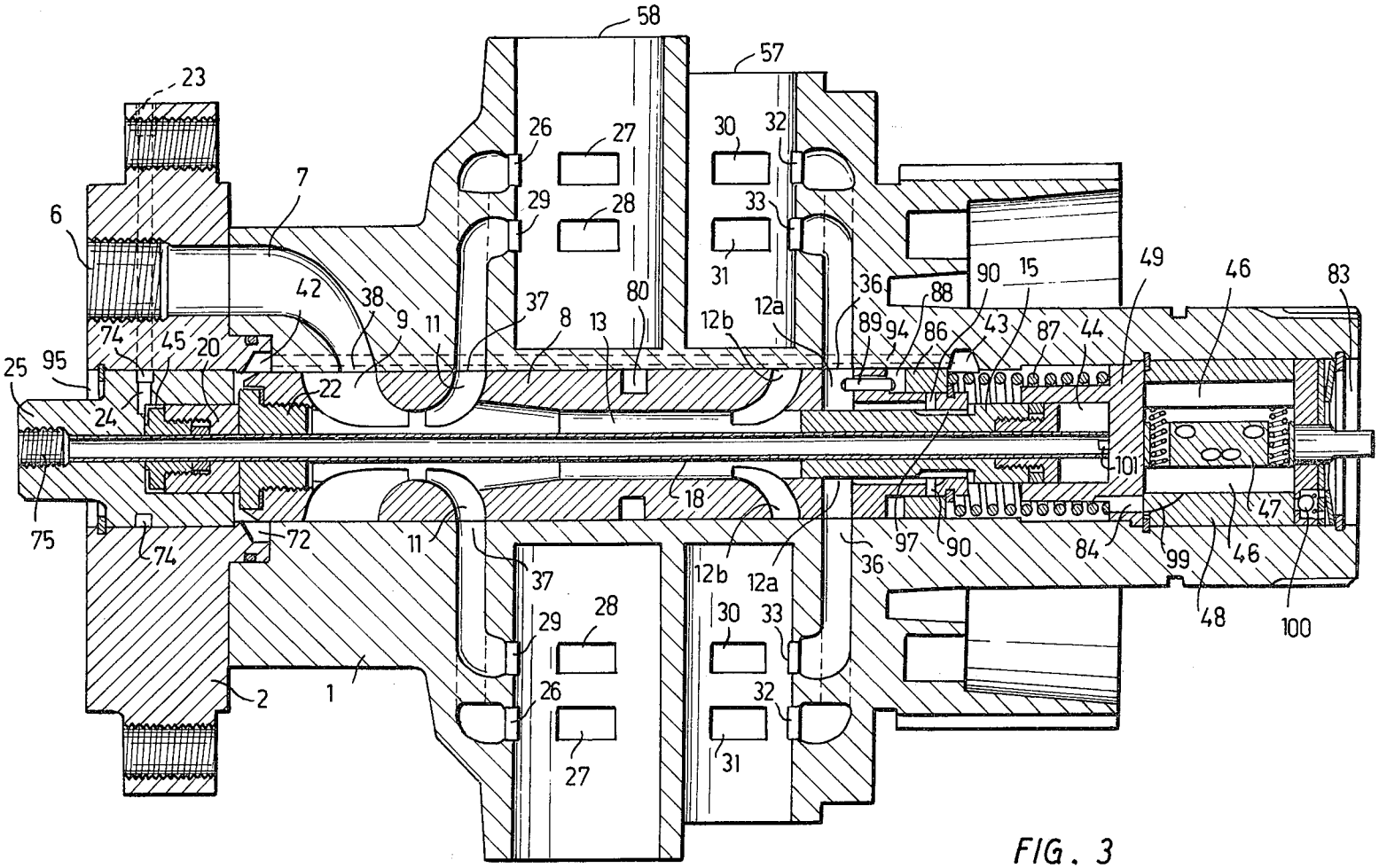
Figure 3A:
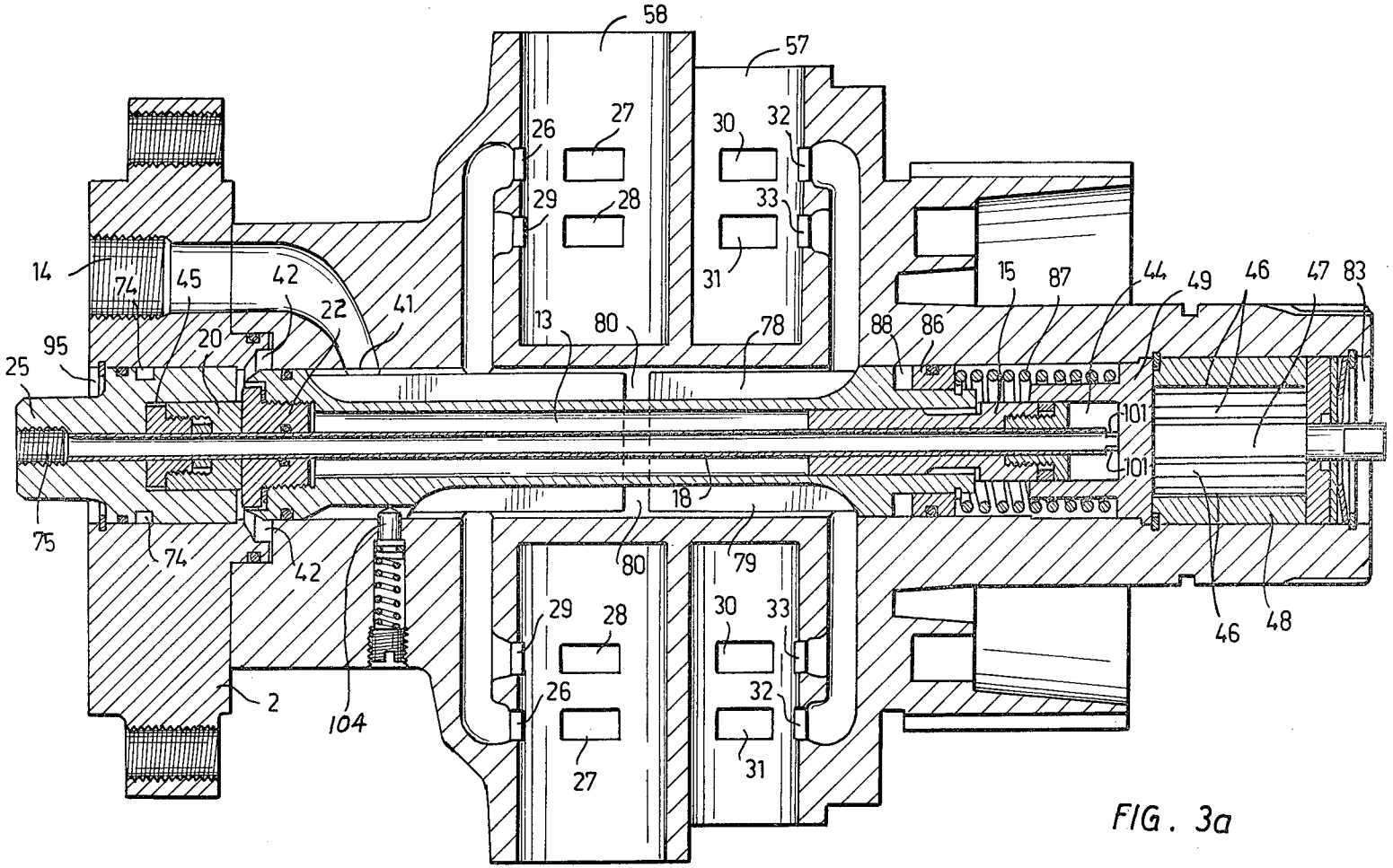
Figure 3B:
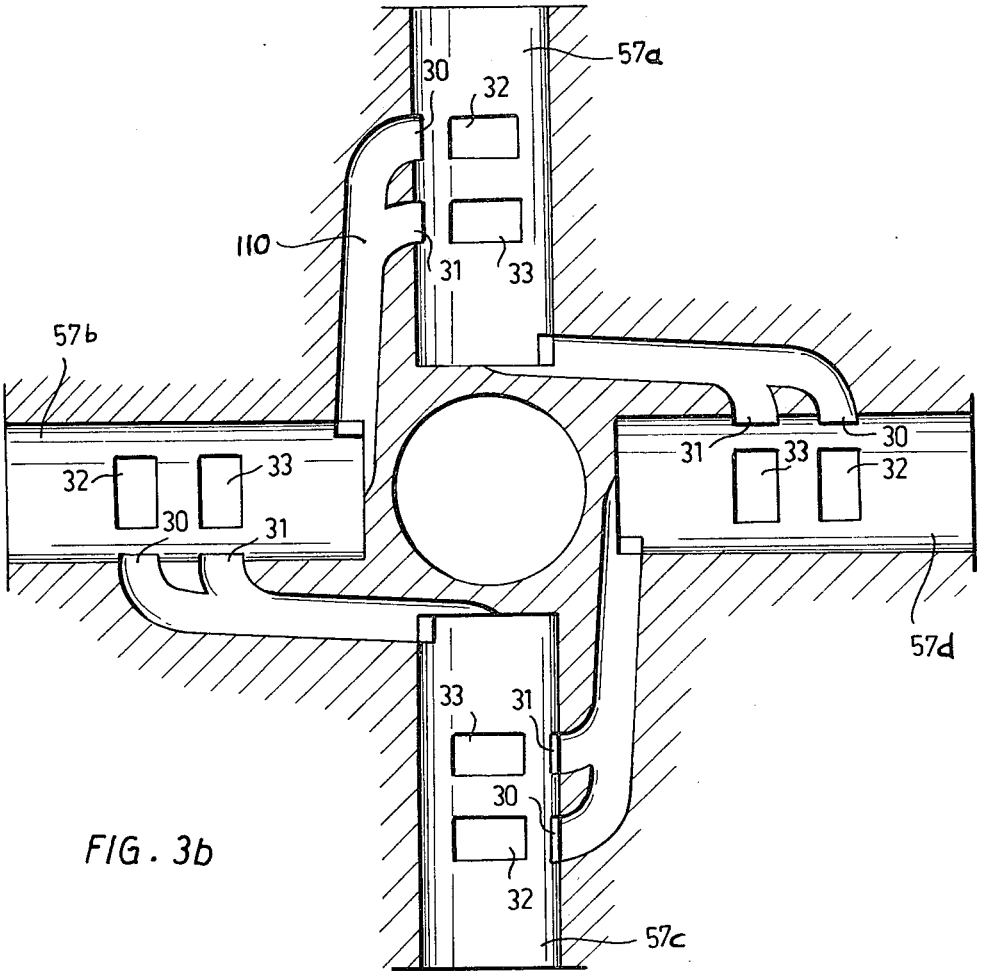
Figure 4:
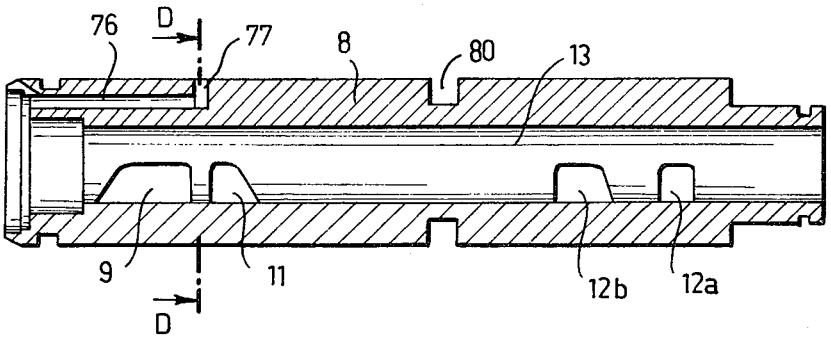
Figure 4A:
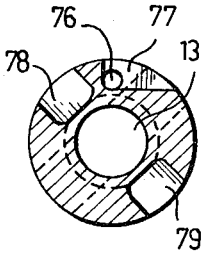
Figure 5:
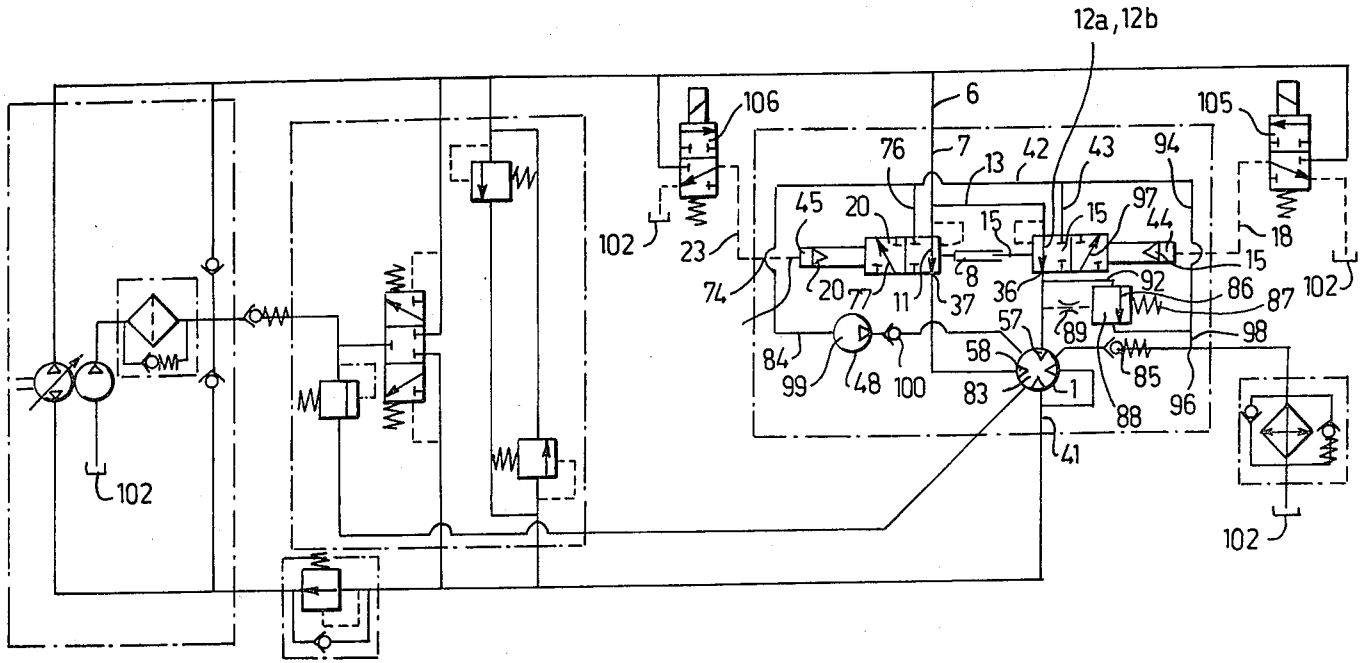

FIG. 2*a* shows a partial longitudinal section, with the pistons and the glide-spindle valve removed, FIG. 3 shows a longitudinal section along line A—A in FIG. 2, with the glide spindle installed, FIG. 3*a* shows a longitudinal section along line B—B in FIG. 2 with the glide spindle installed, FIG. 3*b* shows a transversal section along line C—C in FIG. 2*a*, FIG. 4 shows a longitudinal section of the spindle included in the spindle valve at an angle of 45° in relation to FIG. 3, FIG. 4*a* shows a transversal section along line D—D in FIG. 4, and FIG. 5 shows the hydraulic motor as hydraulic connecting diagram.

The motor consists of a cylinder block with pistons, of a speed-exchange valve system operating in the centre portion of the block, of casing parts with cam rings, and of a lamella type brake equipment built into the motor or any other type of brake system suitable for a vehicle wheel, or no brake at all, of a casing-pressure pump placed in connection with the speed-exchange valve system, as well as of protective covers with seal constructions, and support bearings between the stationary and rotary components.

Figure 1:
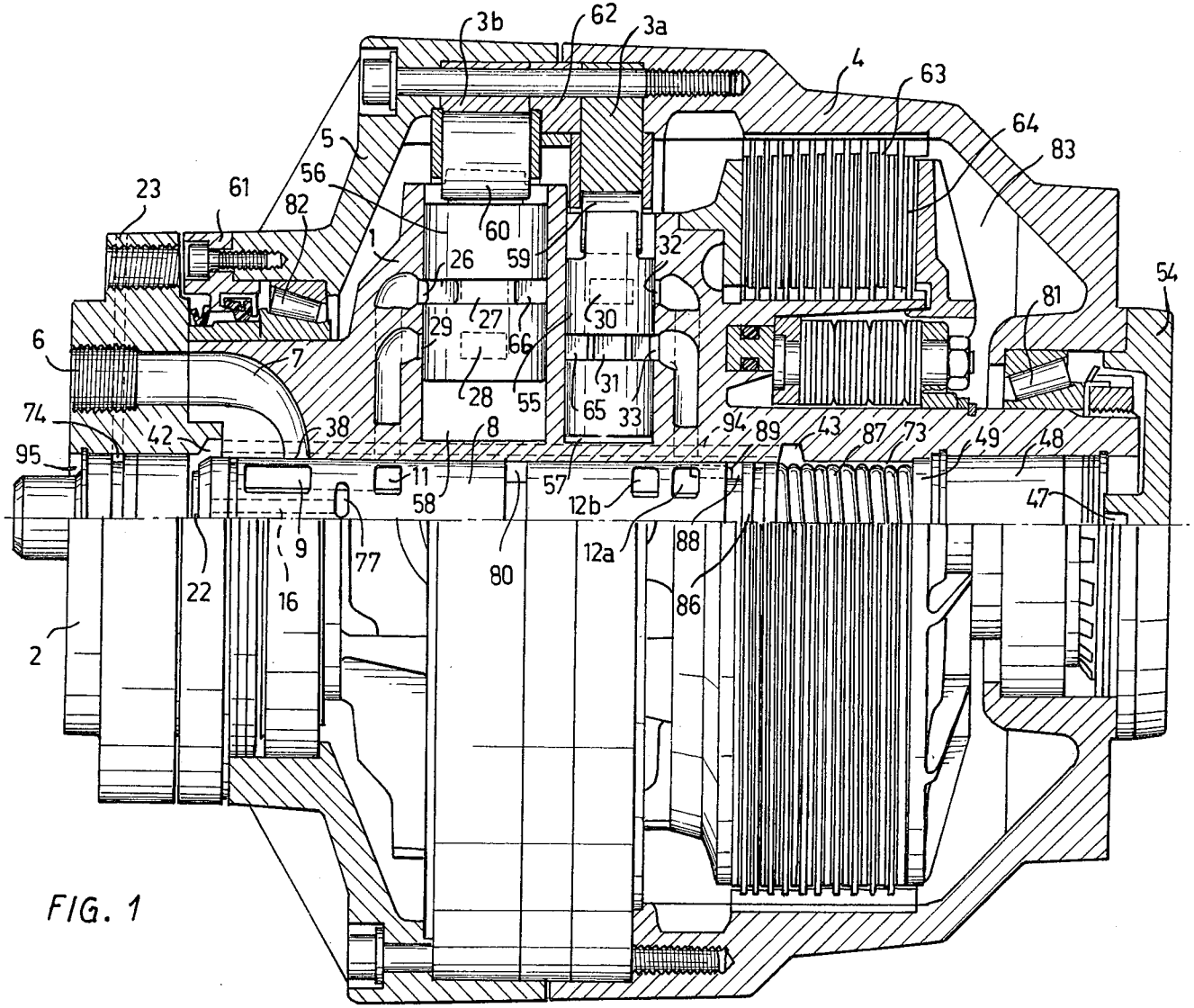
FIG. 1 is a partial longitudinal sectional view of the hydraulic motor.

The four cylinders are directed radially and at an angle of 90° to each other on the same cross-sectional line, FIGS. 1, 2 and 3. There may be one or several sets of four cylinders of this type in one motor. A motor provided with one set of cylinders is a single-speed motor, a motor provided with two cylinder sets (2×4 cylinders) in a two- or three-speed motor, a motor provided with three cylinder sets has seven speed ranges, etc. The motor may have either a rotary casing or a stationary casing. In the latter case the cylinder block with the axle is rotary.

In this description a radial-piston motor provided with two subsequent sets of four cylinders is described, in which motor the casing part rotates with its cam ring while each piston performs one or several power strokes per revolution, depending on the number of cams in the cam ring. The cylinder block and the axle component are stationary.

In the cylinder block of the motor there are two cylinder sets of four cylinders each one after the other, FIGS. 1 and 2, in one set of which the cylinder 58 diameters are larger than in the other 57. To the cylinder block 1 a flange 2 is fastened by means of screws or in some other way, which flange includes, e.g., the pressure and return channels 6 and 14 respectively for the medium drive. The motor is fastened to the machine frame (vehicle or its axle or equivalent) from this flange. The rotary casing part consists of cover casings 4 and 5, cam rings 3*a*, 3*b*, seal box 61 with seals, intermediate ring 62, cover 54, and of brake disks 63 rotating with the casing 5 when the motor is in the composition provided with brakes. To the bore 73 in the centre part of the cylinder block as well as to its extension in the flange 2, bore 95, the speed exchange valve system is placed, which consists of a spindle 8 moving in the axial direction. The rotation of the spindle in the cylinder bore in the cylinder block is prevented by guide means 104, FIG. 3*a*. There is a hole (bore) 13 through the spindle 8 in its centre, and at the other end of the hole there is a plug 22 firmly connected to the spindle and blocking the other end of the hollow interior space of the spindle. Through the plug 22 a pipe 18 passes as sealed against leakages. In the spindle 8 the end opposite to the plug 22 is closed by a second spindle or piston 15 of the second speed range. It goes into the bore 13 in the spindle 8 and is capable of moving therein axially over a limited distance. It is not necessary to prevent its movement in respect of rotation. One end of the piston 15 has a diameter larger than the part moving inside the spindle 8, so that the shoulder in this way produced limits the movement of the part going into the spindle so that the end of the piston 15 blocks the opening 12*a* but does not restrict the opening 12*b*, FIG. 3. In the other direction the movement of the piston 15 is limited by the bottom of the cylinder 44. The thicker end of the piston 15 is capable of moving in the cylinder 44. In the centre of the piston 15 there is also a bore, through which the tube 18 passes while the piston 15 is capable of moving on its mantle face, being at the same time sealed against the mantle face either by means of a fitting or by means of a separate seal. The tube 18 may rest against the bottom of the cylinder 44, but its end resting against the bottom must have a purposeful notch or any other opening 101, in order that, when necessary, the pressurized medium flow passed from the tube 18 has access from the tube into the cylinder space 44, FIG. 3. The plug 22 in the spindle 8 rests against the piston 20 of the third speed range. The components 20 and 22 may also be one piece. The diameter of the piston 20 is larger than the thicker end of the piston 15 of the second speed range. The tube 18 also passes through the piston 20, the sealing facilities being the same as those of the piston 15. The piston 20 may move in the cylinder 45. Into the cylinder space 45 there is connection from outside from the channel 23 through the ring groove 74 or equivalent and the bore 24. The cylinder space 45 is sealed by the piston 20 by means of its outer mantle. From the opening 6 in the flange 2 there is constant connection through the channel 7, opening 38, and through the opening 9 in the spindle 8 to the interior space 13 of the spindle. Here the pressurized medium flow pushes the piston 15 against the bottom of the cylinder and, at the same time, shifts the spindle 8 in the opposite direction while pushing ahead of it the piston 20 in the cylinder 45 to its bottom, for the spaces 44 and 45 are at this time pressure-free, FIGS. 3 and 3*a*. After the spindle 8 has come to the position mentioned above, the openings 11 and 12*a* are above the openings 37 and 36. Then there is medium flow connection to the pressure openings 29 and 33 related to the operations controlling the medium flows of each cylinder as well as connections from the corresponding return openings 26 and 32 to the grooves 78 and 79 on opposite sides of the spindle 8, which grooves are in the spindle 8 at an angle of 90° to the openings 11 and 12*a* and *b* as well as the grooves 78 and 79 are in connection with each other through the groove 80, FIGS. 3*a* and 4, 4*a*. The grooves 78 and 79 are in all positions of the spindle 8 connected to the opening 41, FIGS. 2 and 3*a*, from which further to the return opening 14 in the flange 2, being at the same time always in connection with the openings of 26 and 32 of all cylinders.

When the spindle 8 and the piston 15 are in their extreme opposite positions, all the cylinders of the motor become subjected to the medium flows and the motor operates with its slowest speed range, i.e. in the first speed range. Then the channels 75 and 23 and the spaces 44 and 45 are in the pressure-free state. Thus, therein there is the tank pressure through three-way valves placed outside the motor or built into the motor, valves 105 and 106, FIG. 5. The valves 105 and 106 shown in FIG. 5 are placed outside the motor and can provide control functions to one or more motors. In FIG. 5 the controls are illustrated for one motor, but they may, of course, be branched even for all the motors of the vehicle, including trailers and equivalent coupled to the vehicle. When the spindle of the valve 105 is brought to its second position, the working pressure is connected to the tube 18, whereby the pressure pushes the larger-diameter end of the piston 15 against the end face of the spindle 8. The smaller-diameter end of the piston 15, moving in the spindle 8, is pushed deeper into the spindle 8 and blocks the opening 12*a*. The connection is then broken to the control grooves 65 of the smaller-diameter cylinder set pistons and thereby also to the compression spaces 57 of the controlled cylinders, FIG. 3. The cam ring 3*a* alternately pushes each piston resting against the ring into their inner positions. After the piston 15 has blocked the opening 12*a*, it has at the same time opened a connection through the relief turning or equivalent groove 97 in the smaller-diameter cylinder mantle of the piston 15 from the cylinder spaces 57 to the space 43 via the bore 92 in the spindle 8, whereby the pistons 55, after the middle of their stroke when pushed inwards, press the medium remaining in the cylinders into the space 43, from which there is direct connection to the tank 102 through the bore 94, the space 42, and through the channel 98 to the return opening 96 in the flange 2, FIGS. 1, 2 and 3. Owing to the position of the channel 98, it is not seen in the FIGS. 3 and 3*a*, but it is only seen in FIG. 2. It is connected to the space 42 and may be placed either in the cylinder block or in the flange 2. From the space 43 there is also another connection for removal of the medium. In the casing 49 there is the bore 84, which is connected with the suction space 99 in the casing of the vane or wing pump 48. The vane or wings 46 of the wing pump, which are in the wing grooves of the rotating rotor 47, produce suction in the eccentric casing in a known way in accordance with the principle of functioning of the wing pump thereby shifting medium through its pressure space and the back-stop valve 100 in the pressure channel into the casing space 83. In the casing space there is overpressure controlled by the valve 85 and keeping the pistons pushed in as positioned against the cylinder bottoms. The motor then operates in the second speed range while the entire medium flow passes exclusively into the larger cylinder set. The speed of rotation has increased to the extent of the change in the cylinder volume flow whereas the torque value has been reduced correspondingly, when the values of pressure and medium flow have remained unchanged.

When the working pressure is, by means of the three-way valve 106, also guided into the channel 23, it acts upon the pressure space 45 via the groove 74 and the bore 24. By the effect of the pressure, the piston 20 pushes the spindle 8, which, on the other hand, presses the piston 15 resting against it until the piston 15 is on the bottom of the cylinder 44. This is possible, because the diameter of the piston 20 is larger than the larger end of the piston 15, for the pressure state is now the same in space 45 and in space 44. When the spindle 8 is pushed to the other extreme position, the opening 11 is shifted aside from the opening 37, FIGS. 1 and 2, thereby breaking off the medium flows into the cylinders of the larger cylinder set. Their cam ring, on the other hand, in its turn pushes each of the pistons of the larger cylinder set into their inner positions. When the spindle 8 is shifted, the groove 77 is connected to the opening 37, FIGS. 4 and 5, the groove 77 connects the pressure spaces 58 in the pistons of the larger cylinder set to the tank space via the bore 76 and the space 42 and the channel 98 into the return opening 96 in the flange 2, FIGS. 1, 2 and 6. The occurrences are repeated in the larger cylinder set in the same way as in the second speed range in the smaller cylinder set. The larger-diameter pistons are now in their inner positions owing to the effect of the pressure in the casing, but when the spindle 8 was shifted, it at the same time shifted the opening 12*b* onto the opening 36 of the smaller cylinder set in the cylinder block, whereby the medium has access into the guide grooves 65 of the smaller cylinders and, further, in the proper order, into the pressure space of each cylinder thereby pressing the pistons against the cam ring and to working operation. The motor now operates in the third speed range, owing to the smallest revolution volume reaching the highest range of rotation speed. When the piston 15 was shifted as pushed by the spindle 8, the connection from the opening 36 to the space 43 was blocked at the same time. The casing pressure pump operating in the centre receives its movement of rotation as rotated by the cover 54. Thus, it starts its pumping operation immediately when the wheel starts its movement of rotation and pumps constantly during rotation of the wheel from space 43 into space 83, FIGS. 1, 2 and 5. In addition to leakages, medium flows into the space 43 from the channel 96 and 98 of the back-stop valve 85 next to the tank through the space 42 and the channel 94. The importance of the pump is particularly great when the power machine of the vehicle or equivalent is not in operation and there is no normal medium flow for operation, e.g., when the vehicle is being towed. Thus, when the wheel starts rotation, an overpressure is produced in the casing space keeping the pistons of the motor in their inner positions, and moving of the vehicle without medium drive does not cause difficulty or damage. In a starting of this type the pushing-in of the pistons owing to their casing pressure without particular risk or extra changes in connections of the medium flow system is possible owing to the "towing valve." At the end of the spindle 8 towards the second speed range there is a sleeve 86, which is spring-loaded by means of a spring 87. The spring tends to push the sleeve 86 against the end face of the spindle 8. Into the space 88 there is a choked channel connection from the opening 12*a* of the spindle 8. When the motor operates in the first speed range, the pressure flow can act from the space 13 through the opening 12*a* and through the choke space 89 upon the space 88 thus, despite the spring force 87, preventing the shifting of the sleeve 86 against the end of the spindle 8, because the pressure force on the sleeve 86 is multiple in relation to the spring force. After the pressure states have been lost after stopping of the motor, the spring force pushes the sleeve 86 against the end face of the spindle 8, whereby the grooves 90 connect the space 12*a* through the channel 92 and 90 to the space 43, FIG. 3. The dimensioning of the channels has been performed so that the choke 89 does not have time to admit medium enough through the opening 12*a* into the space 88 to block the connection for the medium flowing away from underneath the pistons of the cylinder sets when the pistons are pushed into their inner positions when the wheel starts rotating without operation of the medium drive system. The movement necessary for the pushing in of the pistons is only the distance of one working stroke, i.e. only part of one revolution of the motor. E.g., in the case of a 5-cam cam ring that means one fifth of a revolution. Thus, when the vehicle starts being towed, some of the pistons that are pushed out in their cylinders are pressed into their inner positions as pushed by the cam rings while the medium flow flows from the pressure spaces of the cylinders through the opening 12*a* along the channel 92 and the grooves 90 into the space 43, from which the casing pressure pump pumps it into the casing space 83. From the casing space the medium flows through the valve 85 into the return channel, to which the space 42 is, on the other hand, connected. Thus, internal circulation is possible when towing takes place with the engine in the "neutral position." On the contrary, the brakes of the motor operate normally. It should be mentioned in this connection that when the motor starts rotating without working pressure circulation, i.e., e.g., when the vehicle is being towed, the pistons, as pushed by the cam rings, produce a pressure in the space 13 of the spindle 8. This pressure automatically shifts the spindle 8 to the position of the first speed range, whereby the switching of the motor to the neutral position, described above, is possible.

When the vehicle is backed, the pressure flow is passed to the return channel 41 of the motor, FIGS. 2 and 5. Then the motor can operate only in the way corresponding the first speed range. The pressure side of forwards driving has now become the return side, in which the return pressure of the closed system couples the exchange valve system of the motor to the position corresponding the first speed range, whereby the pressure flow is guided into the piston controls of the cylinders via the openings 32 and the groove 65 into the channels 30 and further into the compression spaces 57 and into the larger cylinders via the groove 66 of the opening 26 and via the opening 27 into the compression spaces 58, FIG. 3. Since the pressure flow now comes from the return channel of the forwards rotation, the direction of rotation of the motor is reversed. In the inside space 13 of the spindle 8 and in the opening 12*a* there is then a return pressure of the closed system, which is high enough to overcome the force of the spring 87 of the towing valve and keeps the sleeve 86 in the other extreme position, in which the grooves 90 are blocked into space 43.

Outside the pistons 55 and 56 in the cylinders 57 and 58 as well as outside the corresponding pistons of other cylinders corresponding to them there are cam rings 3*a* and 3*b* with wavelike inside faces, which rings, as fastened to casings 4 and 5, can rotate around the cylinder block 1. The pistons 55 and 56 as well as the corresponding pistons of other cylinders are all provided with rollers 59 and 60 or equivalent, which may glide or roll in the boxes or equivalent of the pistons, provided with glide bearings. When a piston is pushed out of the cylinder against the cam ring, the rollers or equivalent roll along the wavelike inside faces of the cam ring, whereby the roll, when passing over the wave top, by the effect of the pressure medium as transmitted by its piston, forces the cam ring to turn away from its way until the wave bottom has been reached. At the same time the pressure medium stops acting upon the piston and the other side of the cam on the cam ring, when moving, again forces the roller and the piston to be pushed back into the cylinder bottom.

The number of cylinders in the star of the motor and the number of cams in the related cam ring must meet certain conditions, of which it is characteristic that in both cylinder sets certain pistons (in the motor in accordance with the example each piston), when performing its power stroke and exhaust stroke, via a groove in the cylinder face of its piston or via a corresponding bore or any other kind of opening, by the intermediate of channel connections placed in the cylinder block, controls the pressure medium flows of the piston and cylinder belonging to the same cylinder set and, regarding its phase sequence, placed at a phase shift of $\frac{1}{4}$ of a cycle alternately to the pressure circuit and to the return circuit, each controlling piston being, on the other hand, at the same time, controlled by another piston placed in the same cylinder set and operating with a phase difference of $\frac{1}{4}$ of a cycle (cycle = power stroke + return stroke). In the motor shown in FIGS. 1 and 2 each piston controls the next or the preceding piston in the same cylinder set, depending on the direction of rotation.

To assist in understanding the flow of the pressure medium through, for example, the smaller diameter cylinder set 57, this description is provided in reference to FIGS. 1, 3*a* and 3*b*, FIG. 3*b* being a section along the line C—C of FIG. 2*a*. In FIG. 3*b*, the cylinders 57 have been distinguished by subscripts for ease of description. Thus, the upper cylinder as viewed in FIG. 3*b* is denoted 57*a*, the lower cylinder 57*c*, and the right-hand cylinder 57*d*. The channel extending from cylinder 57*a* to the bottom of the cylinder 57*b* is denoted 110. When the smaller diameter cylinder set is in the operation, the pressure medium acts in the openings 33. Assume the smaller diameter piston 55 shown in FIG. 1 is, for purposes of this description, in its innermost position and is ready to start a power stroke. Assume further that this piston 55 moves in the cylinder 57*a* in FIG. 3*b*. The pressure medium flows from the opening 33 in the cylinder 57*a* through the piston groove 65 to the opening 31 (FIGS. 1 and 3*b*) and thereafter through the channel 110 to the cylinder space 57*b*. As mentioned previously, the piston moving in the cylinder 57*b* will be one quarter of a cycle ahead of the piston in the cylinder 57*a* and, accordingly, will be half-way alone in its power stroke. Then when the piston 55 in the cylinder 57*a* is half-way along its power stroke, the piston in the cylinder 57*b* will have completed its own power stroke. The groove 65 cuts off the connection between the openings 33 and 31 and immediately thereafter opens the connection between the openings 32 and 30, which new connection remains open until the piston in the cylinder 57*a* is half-way along its return stroke and the piston in the cylinder 57*b* has completed its stroke. The medium will then have been discharged from the cylinder 57*b* through the channel 110 and the opening 30, the groove 65 and the opening 32 to the return channel of the motor. Thereafter, the groove 65 again establishes connection between the openings 33 and 31 and the pressure medium again presses the piston in the cylinder 57*b* outwardly. In the same manner, the piston in the cylinder 57*b* controls the flow of the pressure medium to and from the cylinder 57*c*, and the piston of the cylinder 57*c* controls the medium flow to and from the cylinder 57*d*. The piston in cylinder 57*d* again controls the pressure medium flow to and from the cylinder 57*a*.

The form of the wavelike face between the cams on the cam ring must follow a certain mathematical curve form in order that the piston control of the motor could function without disturbance and in order that the torque developed by the motor at the constant operating pressure should be the same at every moment while the cam form at the same time meets the requirements imposed by the strain and service life.

A motor of the type described above and provided with sets of 4 cylinders may operate as provided with 1, 3, 5 . . . etc. cams, the cam number of the motor being limited to a practicable solution in which the factors are stroke length, magnitude of the diameter of the cam ring, and the diameter of the units rolling against the cam ring, the number of cams being limited to the shape of the tip curve of the cam. It shall be such that its strength properties meet the strain requirements imposed by the service life and operating pressure meant for the motor. The number of cams in the cam ring may, however, in the same motor in each cylinder set, be different. It is only is piston-controlled motors of the above type that it is possible, by changing cam rings of each cylinder set and replacing them by cam rings of different cam numbers, to provide the motor with different transmission ratios depending on the purposes of use of the motor, while all the other components remain unchanged. In this way, when motors are assembled, by mounting cam rings of different cam numbers, it is possible to produce, out of the motors, wheel motors intended for different rpm-ranges and speed ranges in accordance with the buyer's requirements. The other motors so far known do not possess this particular property.

True enough, it should be noticed in this connection that, when the construction of the spindle 8 is in agreement with the drawing in respect of the pressure openings 12*a* and 12*b* of the second cylinder set, if, e.g., the cam number of the first cylinder set were 3 and that of the second cylinder set were 5, or 5 and 7, etc., the cylinder sets would tend to rotate the cam rings in opposite directions in relation to each other. Such an arrangement may in itself also be usable in particular cases in which both cylinder sets of the motor are not used at the same time but one is used for driving forwards and the other one for backing. If the openings 12*a* and 12*b* as well as the components of the grooves 78 and 79 corresponding to them, i.e. to the right from the groove 80 in the drawing, are placed at an angle of 90° to the presented case, the pressure and return openings of the second cylinder set are reversed, whereby the second cylinder set, in the cases of the cam numbers concerned, rotates the cam ring in the same direction as the first cylinder set does. This can be accomplished either by means of a separate spindle 8 formed in this way, or by making the spindle 8 out of two parts so that the part including the openings 12*a* and 12*b* can be locked into two positions at an angle of 90° in relation to each other.

As compared with corresponding motors that are previously known, the motor in accordance with the present invention, in particular constructed as a vehicle wheel, has the following advantages:

The motor has a small size and low weight in comparison to its wide range of torque and rate of revolution.

There are few components that rotate and may cause leakages.

The vehicle can be towed without additional constructions or functions even if the hydrostatic transmission were not in operation.

The motor possesses additional properties important to vehicle use, which properties at the same time make the overall construction of the hydrostatic transmission of the vehicle remarkably simpler and cheaper.

Can be connected to a microprocessor to constitute an automatic gearbox and to make the brakes nonlocking.

What we claim is:

1. A hydraulic motor having an axle with an internal bore, said motor operated by a pressure medium carried in supply and return lines respectively for connection to a reservoir and power supply separate from the motor, said motor comprising first and second sets of cylinders with included pistons radially surrounding the motor axis, the diameter of the cylinders of said first set being smaller than the diameters of said second set;

means internally of the motor and axially movable therein for directing the pressure medium into any one of (a) the two sets of cylinders in combination creating a first motor speed range, (b) the larger diameter cylinder set only creating a second motor speed range, and (c) the smaller diameter cylinder set only creating a third motor speed range, said axially movable pressure medium directing means including a first hollow valve spindle disposed inside the bore of said axle and movable between first and second axially spaced apart positions, the outer wall of first spindle having therein a first opening located to connect the interior space of said spindle with the pressure medium supply line in both positions of said spindle, a second opening located and dimensioned to connect the interior space of said first spindle with the pressure supply conduits of the larger cylinder set when said spindle is in its first position, the connection being broken when said spindle is in its second position, the third opening located to connect the interior space of said first spindle with the pressure supply conduits of the smaller cylinder set when said spindle is in its second position, a fourth opening located to connect the interior space of said first spindle with the pressure supply conduits of the smaller cylinder when said spindle is in its first position, an axial recess located to connect the return conduits of both cylinder sets within the pressure medium return line, and a separate radial groove and axial passageway located to connect the return conduits of the larger cylinder set to the reservoir when said first spindle is in its second position;

a second hollow valve spindle having a portion disposed inside said first spindle and a second portion adjacent the end of said first spindle within the axial bore, said second spindle being movable between first and second axially spaced apart positions, the portion of said second spindle disposed inside said first spindle being of a length that permits the connection between the interior space of first spindle to the pressure supply conduits of the smaller cylinder set through the opening of said first spindle when said second spindle is in its first position relative to said first spindle and which in the second position of said second spindle relative to said first spindle blocks this connection, the outer wall of the portion of said second spindle disposed within said first spindle and the inner surface of the cylindrical wall of said first spindle having axial grooves formed therein that communicate with one another and connect the fourth opening with the reservoir when said spindle is in its second position relative to first spindle;

a piston axially adjacent and in contact with said first valve spindle to move said first valve spindle when pressure is supplied to said piston;

means for controlling the movement of said axially movable means to select the speed range desired; and supply conduits and return conduits for said pressure medium interconnecting the cylinders of said first set with said axially movable pressure medium directing means, the cylinders of said second set with said axially movable pressure medium directing means, and said control means with said axially movable pressure medium directing means.

2. A motor as claimed in claim 1 further comprising means for returning the set of cylinders to the neutral condition that is not receiving pressure medium when the position of said axially movable means is such that only one of said two radial cylinder sets is receiving said pressure medium;

internal pump means driven by the rotation of said motor and creating a pressure difference internally thereof that maintains radial pistons in their inner, neutral position when their respective cylinders are not receiving the pressure medium;

the cylindrical wall of said first spindle having a portion of reduced outer diameter adjacent the end receiving saide second spindle, said reduced wall portion having a radial bore formed therethrough adjacent the axial groove on the inner surface thereof, a sleeve slidably mounted over said reduced wall portion, spring means coaxially mounted over said reduced wall portions in contact with said sleeve and urging said sleeve in axial movement, the wall separating said reduced portion between the fourth opening and said reduced portion having a small diameter opening therethrough providing restricted communication between the fourth opening and the end of said sleeve opposite said spring means, said sleeve being axially slidable between a first position covering said radial bore and obtained when the hydraulic pressure through the small diameter opening is greater than the force of said spring means and a second position freeing said radial bore when the hydraulic pressure is lost to provide communication between the interior space of said first spindle, said internal pump means, and the reservoir, whereby when hydraulic pressure to power the motor is lost, said motor can be rotated by external means without internal hindrance.

3. A motor as claimed in claim 1 wherein the second portion end of said second spindle is contained within a first cylinder housing disposed within the axial bore of said motor, wherein said second valve spindle extends inside said first valve spindle through one end thereof and the movement of said second spindle to its first position relative to said first spindle is limited by said first cylinder housing in the axial bore, and wherein said second spindle includes a shoulder formed intermediate the portion disposed inside said first spindle and the second portion of said second spindle, which shoulder limits the movement of said second spindle as it contacts the ends of said first spindle when said second spindle moves to its second position relative to said first spindle.

4. A motor as claimed in claim 3 further comprising a hollowed space in the motor axle adjacent said second spindle having a connection to the reservoir and wherein the groove in the portion of said second spindle that is disposed within said first spindle extends axially beyond said shoulder and opens into said hollowed space even when said shoulder is in contact with the end of said first spindle.

5. A motor as claimed in claim 3 wherein said piston is located adjacent the end of said first spindle that is opposite the end associated with said second spindle, wherein said piston is contained within a second cylinder housing also located within the axial bore of said motor, and wherein the movement of said first spindle to its first position is limited by said second cylinder housing and the intermediate position of said piston and the movement of said first spindle to its second position is limited by said first cylinder housing and the intermediate position of said second spindle.

6. A motor as claimed in claim 5 wherein the axial cross-sectional area of the interior space of said first spindle is smaller than the cross-sectional area of said second portion of said second spindle in said first cylinder housing, and the cross-sectional area of said second portion is smaller than the cross-sectional area of the piston, whereby:

when the pressure medium acts only on the interior space of said first spindle, said first spindle is moved to its first position and said second spindle is moved to its first position relative to said first spindle creating a first position for the combination of valve spindles wherein the pressure medium is directed to both said radial cylinder sets and the motor operates in its first speed range;

when the pressure medium acts upon the interior space of said first spindle and upon the outer end of said second spindle from within said first cylinder housing, said second spindle is moved to its second position relative to said first spindle creating the second position for the combination of valve spindles wherein the pressure medium is directed only to said radial cylinder set having the larger diameter and the motor operates in its second speed range; and when the pressure medium acts upon the interior space of said first spindle and upon the outer end of said second spindle within said first cylinder housing and upon the outer end of said piston within said second cylinder housind, said first spindle is moved to its second position, because of the larger cross-sectional area of said piston providing the greater force, creating a third position for the combination of valve spindles wherein the pressure medium is directed only to said radial cylinder set having the smaller diameter and the motor operates in its third speed range.

7. A motor as claimed in claim 5 further comprising channel means connecting the interior space of said second valve spindle, the cylinder space within said second cylinder housing adjacent said piston, the pressure medium supply conduit, and said means for controlling the axial movement of said axially movable pressure medium directing means.

8. A motor as claimed in claim 7 wherein said channel means includes a tube extending through said first spindle and said piston from said second valve spindle.

* * * * *